US007264118B2

(12) United States Patent
Chen

(10) Patent No.: US 7,264,118 B2
(45) Date of Patent: Sep. 4, 2007

(54) COMPACT TOOLBOX

(76) Inventor: Kun-Chen Chen, No. 6, Lane 609, Sec. 1, Chung-Shan Rd., Ye-Her Li, Tachia Chen, Taichung Hsien (TW)

( * ) Notice: Subject to any disclaimer, the term of this patent is extended or adjusted under 35 U.S.C. 154(b) by 473 days.

(21) Appl. No.: 10/994,323

(22) Filed: Nov. 23, 2004

(65) Prior Publication Data

US 2006/0108246 A1 May 25, 2006

(51) Int. Cl.
*B65D 85/28* (2006.01)

(52) U.S. Cl. ..... 206/372; 206/379

(58) Field of Classification Search ..... 206/349, 206/372–379; 211/69, 70.6; 312/902
See application file for complete search history.

(56) References Cited

U.S. PATENT DOCUMENTS 2,305,021 A * 12/1942 Meier ..... 206/379
4,006,821 A * 2/1977 Sautter ..... 206/379
5,570,784 A * 11/1996 Sidabras et al. ..... 206/378
5,893,457 A * 4/1999 Wei ..... 206/373
6,994,214 B2 * 2/2006 Yang ..... 206/379
2005/0023167 A1 * 2/2005 Yang ..... 206/373
2005/0178686 A1 * 8/2005 Pangerc et al. ..... 206/379

* cited by examiner

*Primary Examiner*—Luan K. Bui
(74) *Attorney, Agent, or Firm*—Bacon & Thomas, PLLC

(57) ABSTRACT

A compact toolbox has a case and multiple containers. The case has an outer case and an inner case. The inner case is attached pivotally to the outer case. The outer case has a rear housing and a front housing. The rear housing is attached pivotally to the front housing. The containers are mounted in the case, are attached pivotally to the case and have multiple bit holes. The bit holes are different sizes. Drill bits are stowed in the bit holes. By pivoting the case and the containers, the case and the containers are stacked for storage. Therefore the compact toolbox not only occupies a small volume but also can organize and stow many different sized drill bits.

11 Claims, 7 Drawing Sheets

COMPACT TOOLBOX

BACKGROUND OF THE INVENTION

1. Field of the Invention

The present invention relates to a toolbox, especially to a compact toolbox that has multiple storage compartments.

2. Description of the Prior Art

Drilling machines such as hand drills and drill presses use drill bits to drill holes in wood, metal and masonry. To drill holes of many sizes, drill bits are available in many different sizes. A conventional way to stow the drill bits and other rotary tool heads is to put the drill bits and tool heads loosely in a box. To find a specific sized drill bit, people have to rummage through the box to find the correct size drill bit. A conventional toolbox is available that can store many different sized drill bits in an orderly manner to let people easily find a specific sized drill bit. However, the conventional toolbox that can hold most sizes of drill bits is very large because so many different sized drill bits are available. A large toolbox will occupy a lot of space.

To overcome the shortcomings, the present invention provides a compact toolbox that occupies a small volume to mitigate or obviate the aforementioned problems.

SUMMARY OF THE INVENTION

The main objective of the present invention is to provide a compact toolbox that not only occupies a small volume but also organizes and holds many different sized drill bits and tool heads.

A compact toolbox has a case and multiple containers. The case has an outer case and an inner case. The inner case is attached pivotally to the outer case. The outer case has a rear housing and a front housing. The rear housing is attached pivotally to the front housing. The containers are in the case, are attached pivotally to the case and have multiple bit holes. The bit holes are different sizes. The drill bits are stowed in the bit holes. By pivoting the case and the containers, the case and the containers are stacked for storage. Therefore the compact toolbox not only occupies a small volume but also can organize and stow many different sized drill bits and tool heads.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
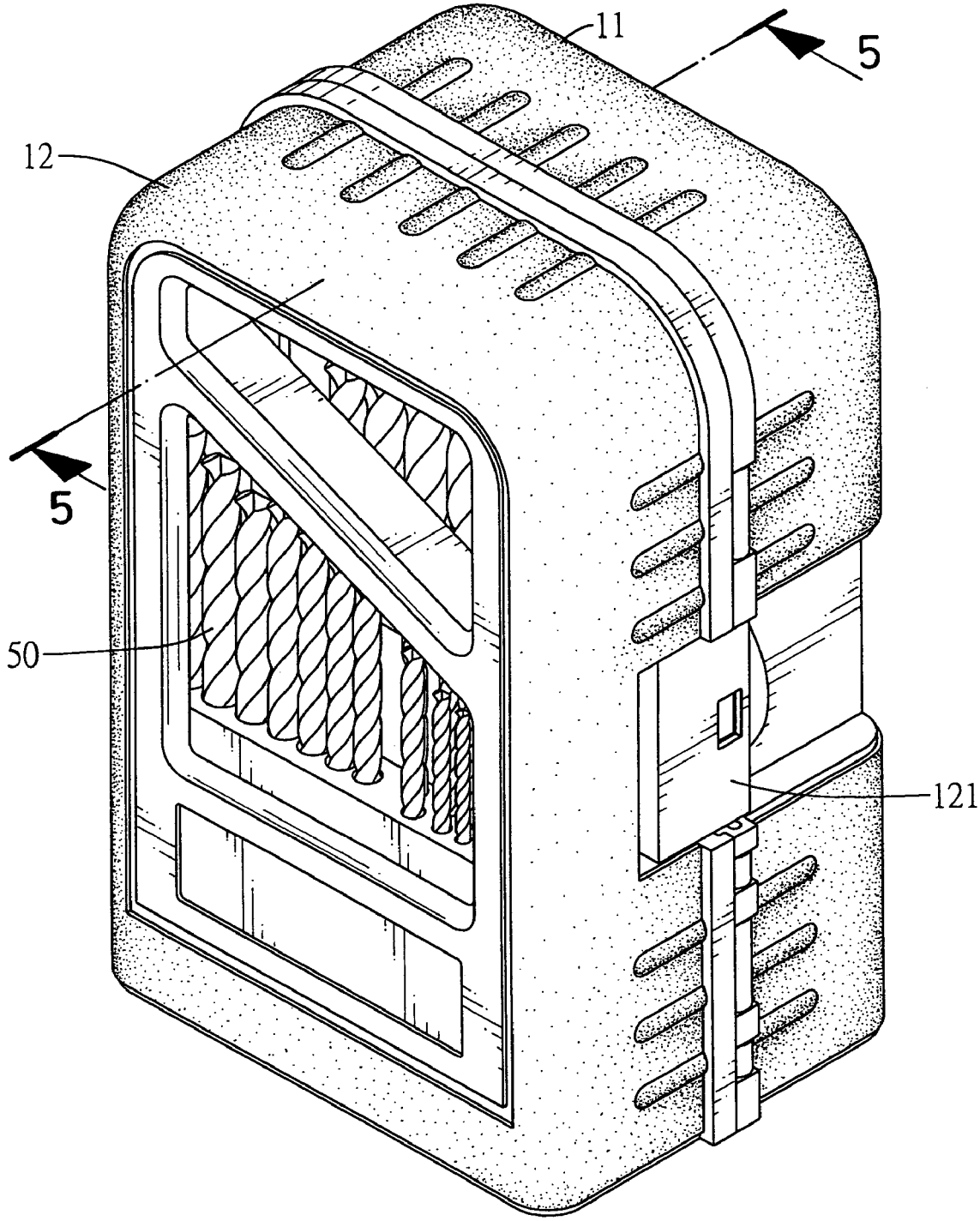
FIG. 1 is a perspective view of a first embodiment of a compact toolbox in accordance with the present invention to store drill bits.

With reference to FIGS. 1, 2, 3 and 6, a compact toolbox in accordance with the present invention comprises a case, multiple containers (30), multiple optional pivot pins (40, 401, 402) and an optional tool head/accessory housing (60). The case has an outer case (10) and an inner case (20). The outer case (10) has a rear housing (11) and a front housing (12).

The rear housing (11) has an open front, a closed rear, a pivoting side, a locking side, a latch, multiple optional hinge barrels (112) and multiple optional gaps (113). The latch is formed on locking side of the rear housing (11) and may be a protrusion (111) or a detent. The hinge barrels (112) are formed on the pivoting side and the locking side of the rear housing (11). The gaps (113) are formed in the pivoting side and the locking side of the rear housing (11) adjacent to the hinge barrels (112).

The front housing (12) is attached pivotally to the rear housing (11) and has an open rear, a closed front, a pivoting side, a locking side, a latch, multiple optional hinge barrels (122), multiple optional gaps (125), an optional positive stop (123) and an optional window (124). The latch is formed on the locking side of the front housing (12), corresponds to and selectively engages the latch on the rear housing (11) to selectively hold the outer case (10) closed and may be a resilient clamp (121). The resilient clamp (121) may have a hole to selectively engage the protrusion (111) or a boss to selectively engage the detent. The hinge barrels (122) are formed on the pivoting side of the front housing (12) and corresponds to and align with the hinge barrels (112) on pivoting side of the rear housing (11). The gaps (125) are formed on the pivoting side of the front housing (12) adjacent to the hinge barrels (122) on the front housing (12) and corresponds to the gaps (113) on the pivoting side of the rear housing (11). The positive stop (123) is formed in the front housing (12) on the closed front of the front housing (12). The window (124) is formed through the closed front of the front housing (12).

The inner case (20) is attached pivotally to the outer case (10) and individually has an open rear, a closed front, a pivoting side, multiple optional hinge barrels (21), multiple optional gaps (24), an optional positive stop (22) and an optional window (23). The hinge barrels (21) are formed on the pivoting side of the inner case (20) and corresponds to and align with the hinge barrels (112) on the locking side of the rear housing (11). The gaps (24) are formed on the pivoting side of the inner case (20) and corresponds to the gaps (113) in the locking side of the rear housing (11). The positive stop (22) is formed in the inner case (20) on the closed front. The window (23) is formed through the closed front of the inner case (20). In the preferred embodiment, the compact toolbox has one inner case (20).

The containers (30) are attached pivotally to and are selectively mounted respectively in the outer case (10) and inner case (20) from the corresponding open front and rear. Each container (30) has a pivoting side, a top, multiple bit holes (31), multiple optional hinge arms (33) and multiple pivot holes (32). The bit holes (31) are formed in the top of the container (30) and each bit hole (31) has a different measurement. The hinge arms (33) are formed on the pivoting side of the container (30) and are mounted selectively in the gaps (113, 125, 24) in the outer case (10) and the inner case (20). The pivot holes (32) are formed respectively in the hinge arms (33). In the preferred embodiment, the compact toolbox has three containers (30), and the three containers (30) are mounted respectively in the front housing (12), rear housing (11) and the inner case (20).

Figure 4:
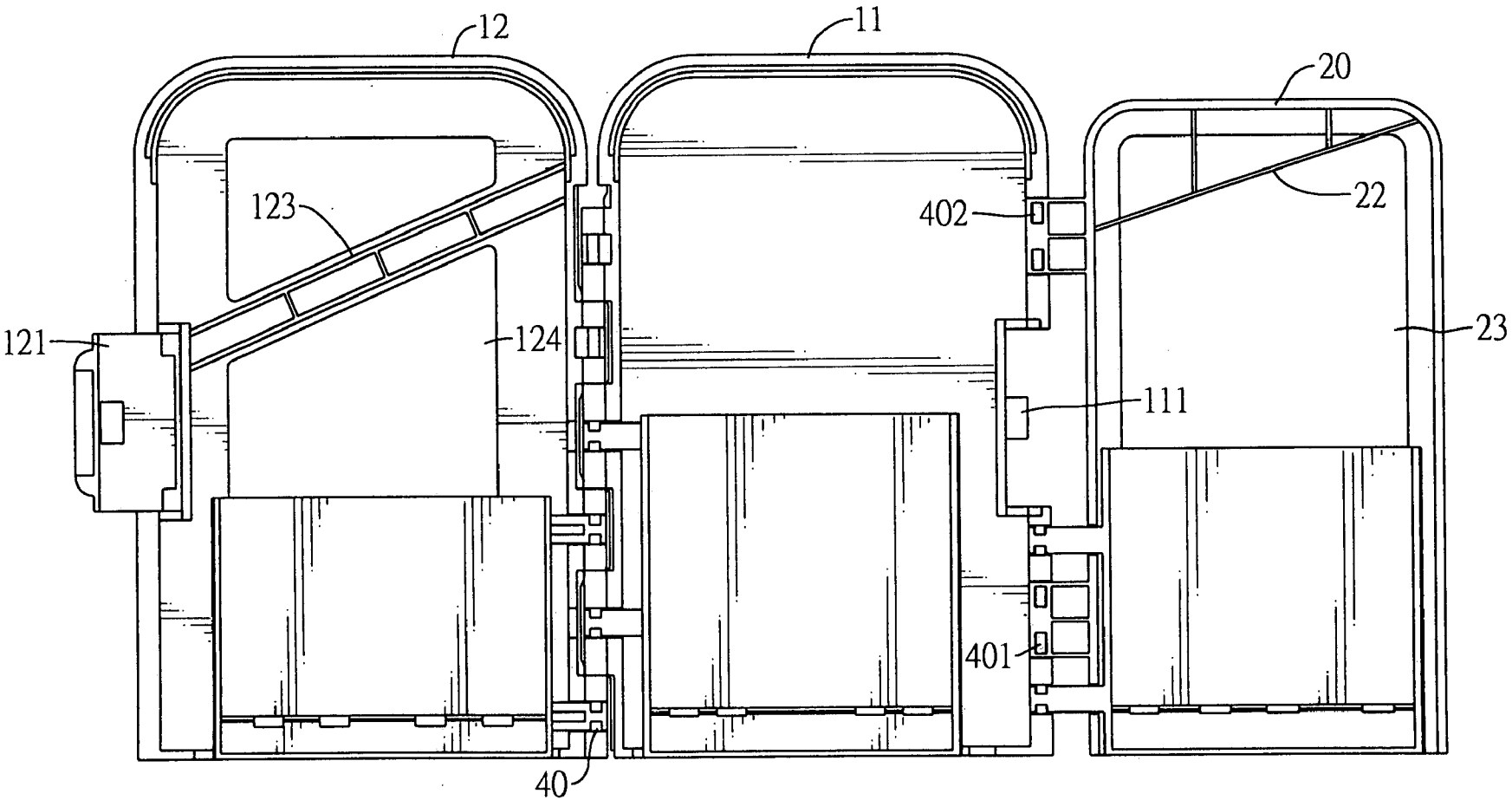
FIG. 4 is a front view of the compact toolbox in FIG. 2.

With further reference to FIG. 4, the pivot pins (40, 401, 402) comprises a first pivot pin (40), a second pivot pin (401) and a third pivot pin (402). The first pivot pin (40) passes through and is mounted in the pivot holes (32) in the containers (30) and the hinge barrels (112, 122) on the pivoting sides of the rear housing (11) and the front housing (12). The second pivot pin (401) passes through and is mounted in the pivot holes (32) in the containers (30) and the hinge barrels (112, 21) on the locking side of the rear housing (11) and on the pivoting side of the inner case (20). The third pivot pin (402) passes through and is mounted in the hinge barrels (112, 21) on the locking side of the rear housing (11) and on the pivoting side of the inner case (20).

Figure 6:
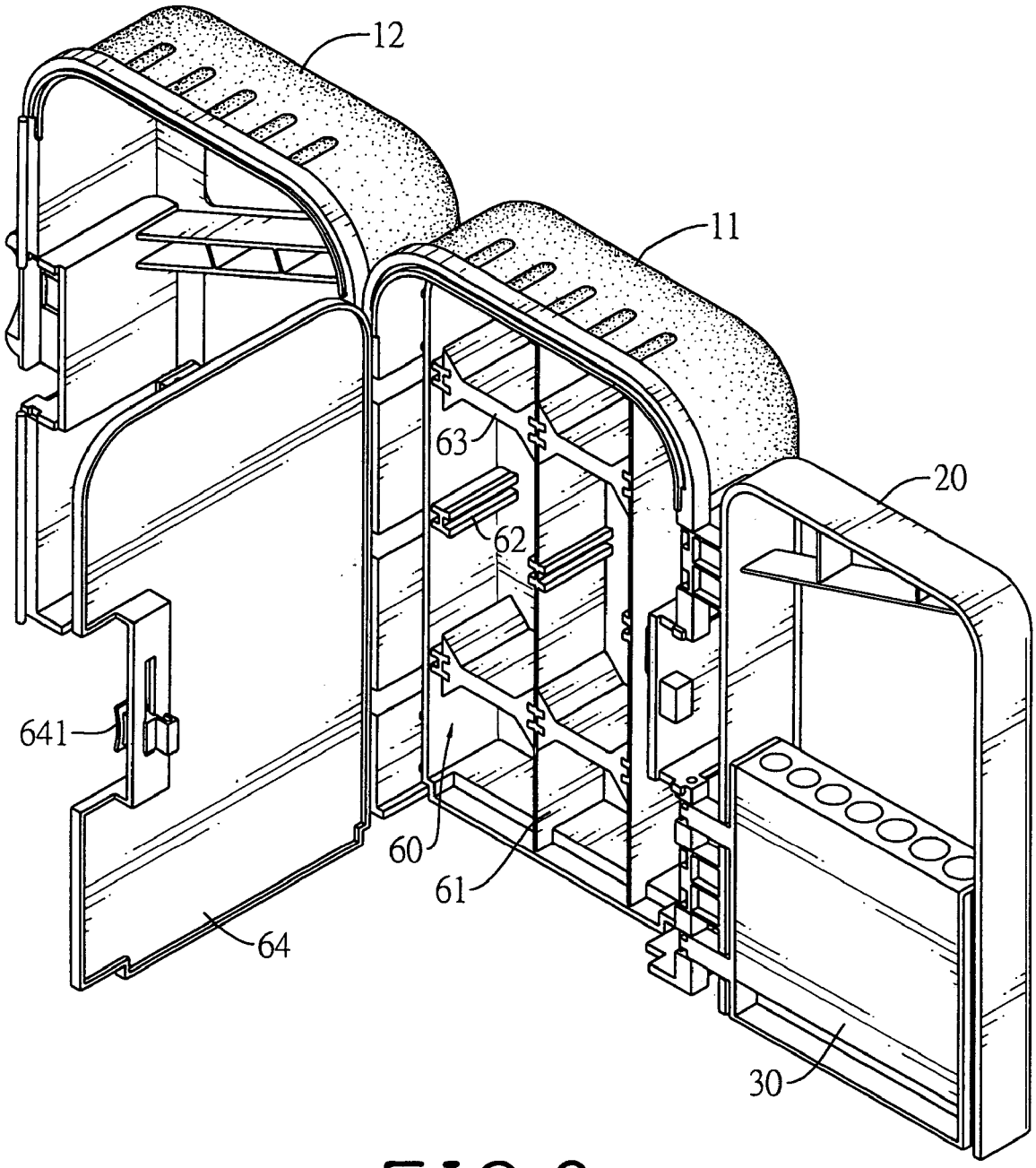
FIG. 6 is a perspective view of a second embodiment of a compact toolbox in accordance with the present invention to store drill bits, tool heads and other miscellaneous accessories.
Figure 7:
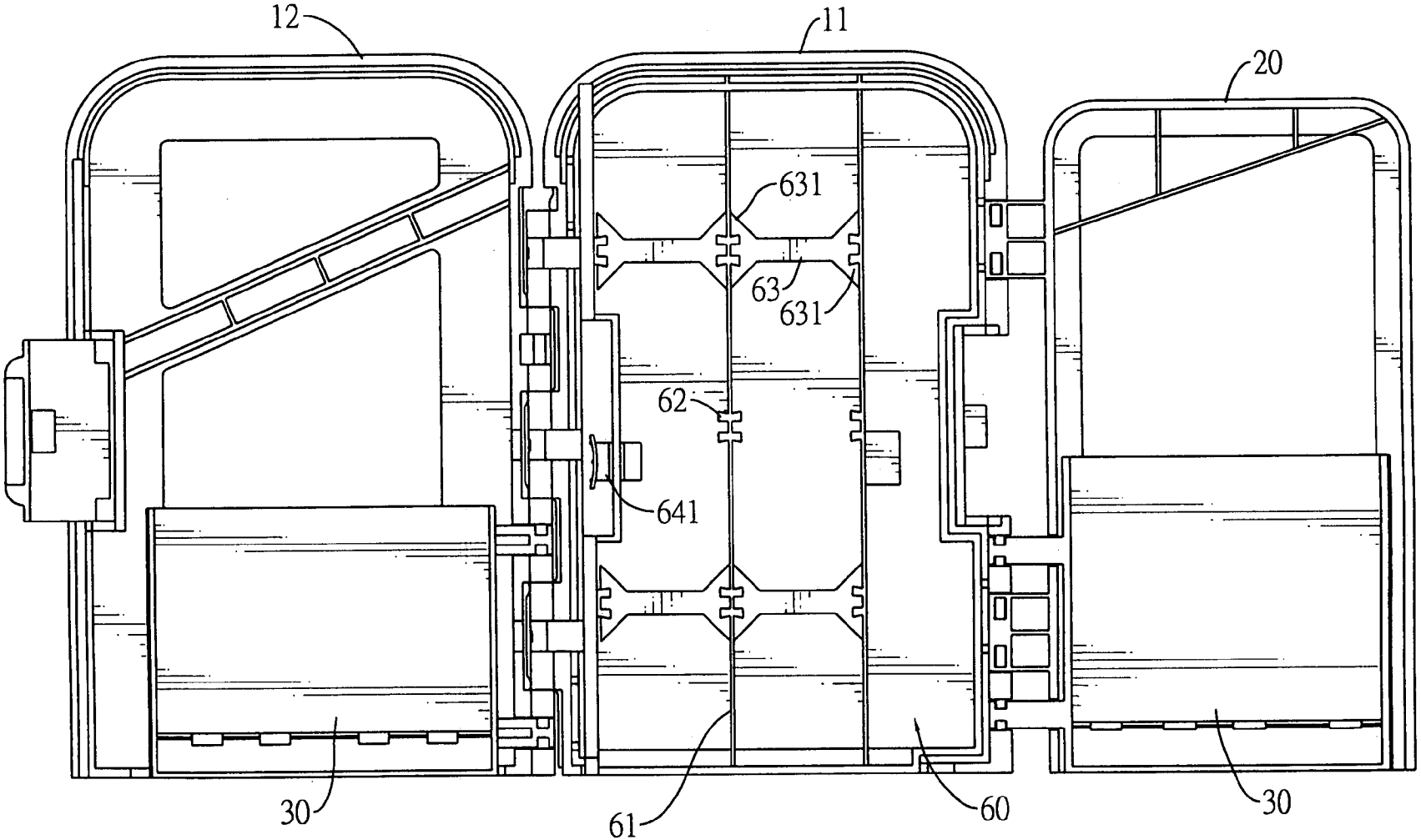
FIG. 7 is a front view of the compact toolbox in FIG. 6.

With further reference to FIGS. 6 and 7, the tool head/accessory housing (60) is mounted securely in the rear housing (11) and comprises an inner surface, multiple partition panels (61), multiple divider panel slots (62), multiple divider panels (63) and a cover (64). The partition panels (61) are attached to the inner surface to divide the tool head/accessory housing (60) into multiple major sections. The divider panel slots (62) are formed on the partition panels (61). Each divider panel (63) has two ends (631). The two ends (631) correspond to and engage the divider panel slots (62) to selectively divide each major section into individual compartments. The cover (64) is mounted pivotally on the tool head/accessory housing (60) and has a locking device (641) to selectively lock the cover (64) on the tool head/accessory housing (60). Small tools such as jeweler's screwdrivers, small tool heads such as router bits and accessories such as screws, nuts, cotter pins, C-clips and the like can be stored in the tool head/accessory housing (60).

Figure 2:
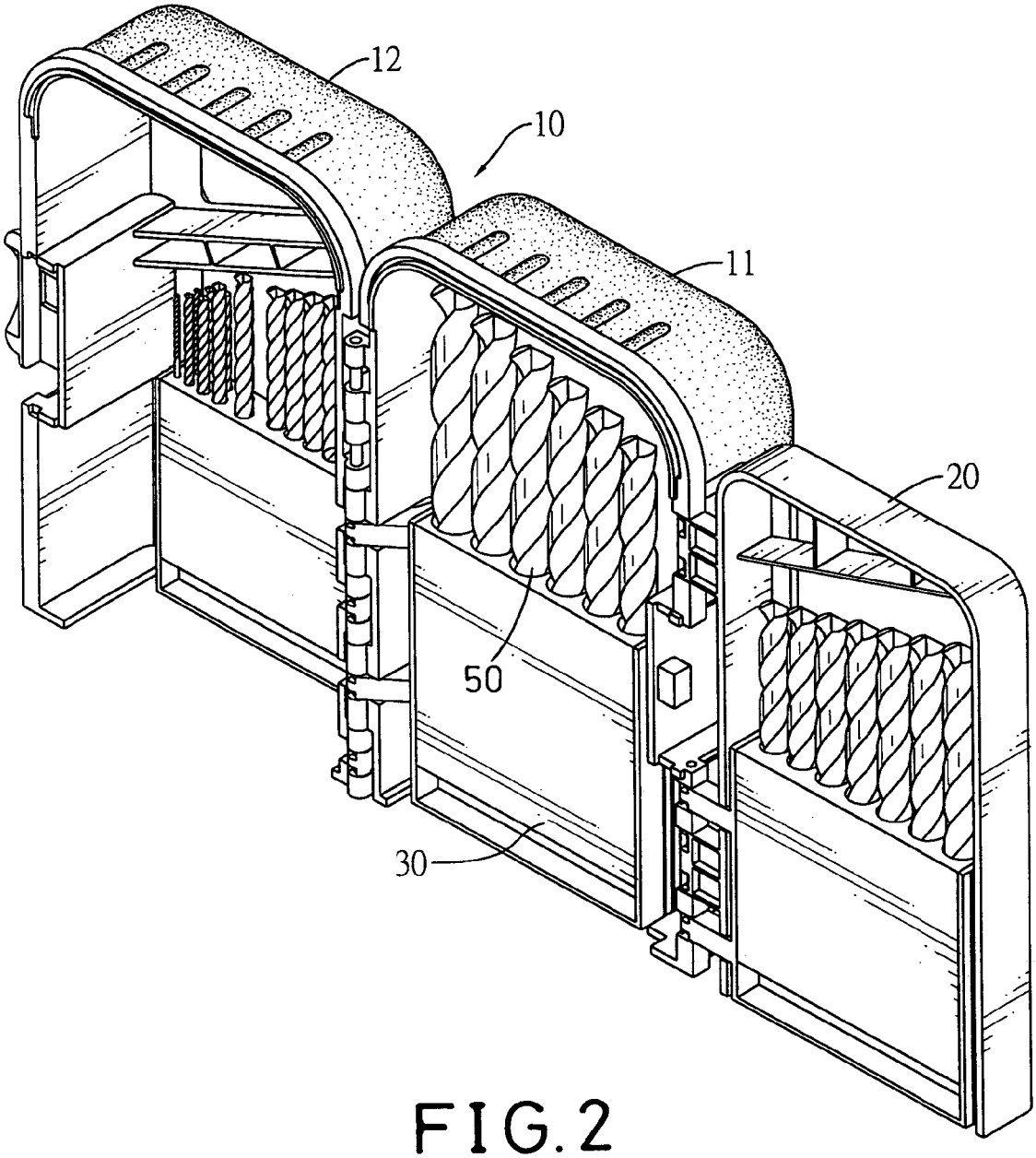
FIG. 2 is a perspective view of the compact toolbox in FIG. 1 with cases open.
Figure 3:
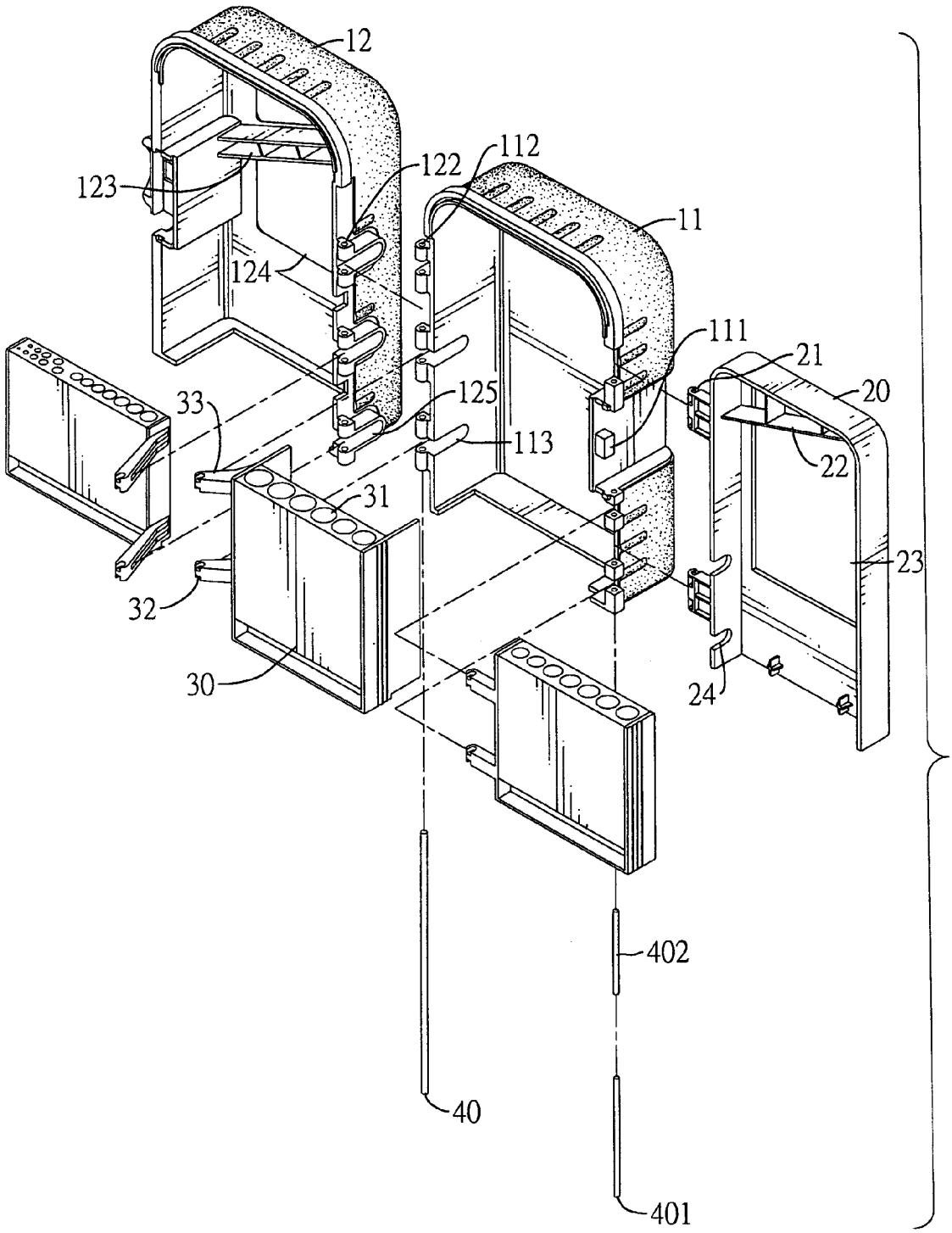
FIG. 3 is an exploded perspective view of the compact toolbox in FIG. 2.

With further reference to FIG. 2, the compact toolbox is opened to select different sized drill bits (50) or store drill bits (50) respectively in the appropriate bit holes (31). The containers (30) can be pivoted respectively out of the outer case (10) and the inner case (20) from the corresponding open front or rear, and the drill bits (50) are easy to put into or remove from the bit holes (31). Therefore, the drill bits (50) and accessories are sorted, and the user easily finds a specific sized drill bit (50) or accessory.

Figure 5:
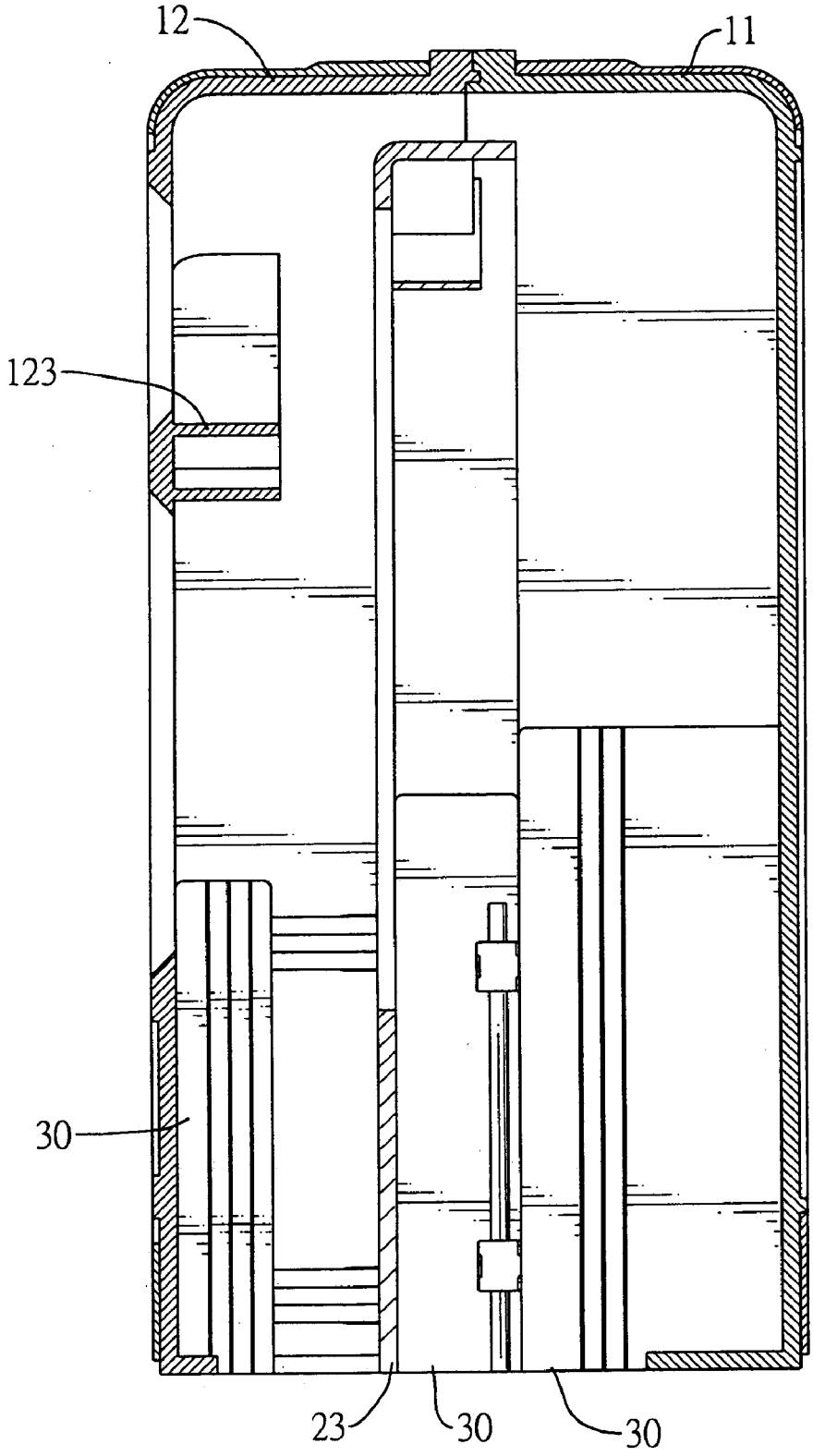
FIG. 5 is a side view in partial section of the compact toolbox along line 5-5 in FIG. 1.

With further reference to FIG. 5, the compact toolbox can be closed when the compact toolbox is not used. The containers (30) pivot respectively into the outer case (10) and the inner case (20), and the inner case (20) pivots into the outer case (10). Then the outer case (10), the inner case (20) and the containers (30) are stacked for storage. Therefore the compact toolbox is not only large enough to hold many different sized drill bits (50) and accessories but also occupies a small volume when the compact toolbox is closed.

Even when the compact toolbox is tipped over or inadvertently turned upside down, the positive stops (123, 22) will keep the drill bits (50) from sliding out of the bit holes (31) and the cover (64) will hold accessories in the individual compartments.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A compact toolbox comprising
a case having
an outer case having
a rear housing having
an open front;
a closed rear;
a pivoting side;
a locking side; and
a latch formed on the locking side;
a front housing attached pivotally to the rear housing and having
an open rear;
a closed front;
a pivoting side;
a locking end; and
a latch formed on the locking side of the front housing and corresponding to the latch on the locking side of the rear housing to selectively hold the outer case closed;
an inner case attached pivotally to the outer case and having
an open rear;
a closed front; and
a pivoting side; and
multiple containers attached pivotally to and are selectively in the outer case and inner case from the corresponding open front and rear and individually having
a pivoting side;
a top; and
multiple holes formed in the top of the container and individually having a different measurement.

2. The compact toolbox as claimed in claim 1, wherein
the rear housing further comprises
multiple hinge barrels formed on the pivoting side and the locking side of the rear housing; and
multiple gaps formed in the pivoting side and the locking side of the rear housing adjacent to the hinge barrels;
the front housing further comprises
multiple hinge barrels formed on the pivoting side of the front housing and corresponding to the hinge barrels on pivoting side of the rear housing; and
multiple gaps formed on the pivoting side of the front housing adjacent to the hinge barrels on the front housing and corresponding to the gaps on the pivoting side of the rear housing;
the inner case further comprises
multiple hinge barrels formed on the pivoting side of the inner case and corresponding to and align with the hinge barrels on the locking side of the rear housing; and
multiple gaps formed on the pivoting side of the inner case and corresponding to the gaps in the locking side of the rear housing;
each container further comprises
multiple hinge arms formed on the pivoting side of the container and mounted selectively in the gaps in the outer case and the inner case; and
multiple pivot holes formed respectively in the hinge arms;
the compact toolbox further comprises
a first pivot pin passing through and mounted in the pivot holes in the containers and the hinge barrels on the pivoting sides of the rear housing and the front housing;

a second pivot pin passing through and mounted in the pivot holes in the containers and the hinge barrels on the locking side of the rear housing and on the pivoting side of the inner case; and a third pivot pin passing through and mounted in the hinge barrels on the locking side of the rear housing and on the pivoting side of the inner case.

3. The compact toolbox as claimed in claim 2, wherein the latch on the rear housing is a protrusion; and the latch on the front housing is a resilient clamp selectively engaging the protrusion.

4. The compact toolbox as claimed in claim 3, wherein the front housing further comprises a window formed through the closed front of the front housing; and the inner case further comprises a window formed through the closed front of the inner case.

5. The compact toolbox as claimed in claim 4, wherein the front housing further comprises a positive stop formed in the front housing on the closed front; and the inner case further comprises a positive stop formed in the inner case on the closed front.

6. The compact toolbox as claimed in claim 5 comprising three containers, and the three containers pivotally attached respectively to and selectively mounted respectively in the front housing, rear housing and the inner case.

7. The compact toolbox as claimed in claim 1, wherein the latch on the rear housing is a protrusion; and the latch on the front housing is a resilient clamp selectively engaging the protrusion.

8. The compact toolbox as claimed in claim 1, wherein the front housing further comprises a window formed through the closed front of the front housing; and the inner case further comprises a window formed through the closed front of the inner case.

9. The compact toolbox as claimed in claim 1, wherein the front housing further comprises a positive stop formed in the front housing on the closed front; and the inner case further comprises a positive stop formed in the inner case on the closed front.

10. The compact toolbox as claimed in claim 1 comprising three containers, and the three containers pivotally attached respectively to and selectively mounted respectively in the front housing, rear housing and the inner case.

11. The compact toolbox as claimed in claim 1 further comprising a tool head/accessory housing mounted securely in the rear housing and having an inner surface;

multiple partition panels attached to the inner surface to divided the tool head/accessory housing into multiple major sections;

multiple divider panel slots formed on the partition panels;

multiple divider panels individually having two ends corresponding to and engaging the divider panel slots to selectively divide each major section into individual compartments; and a cover mounted pivotally on the tool head/accessory housing and having a locking device to selectively lock the cover on the tool head/accessory housing.

* * * * *